US011208615B2

(12) United States Patent
Zahajko et al.

(10) Patent No.: US 11,208,615 B2
(45) Date of Patent: Dec. 28, 2021

(54) ASPHALT SURFACE CLEANING COMPOSITION WITH BITUMEN REHARDENING AND METHOD

(71) Applicants: Michael Zahajko, Maple Valley, WA (US); Michael Gregory Zahajko, Maple Valley, WA (US); Derek Zahajko, Maple Valley, WA (US); Kimball Garvin, Maple Valley, WA (US); Eric Jensen, Maple Valley, WA (US)

(72) Inventors: Michael Zahajko, Maple Valley, WA (US); Michael Gregory Zahajko, Maple Valley, WA (US); Derek Zahajko, Maple Valley, WA (US); Kimball Garvin, Maple Valley, WA (US); Eric Jensen, Maple Valley, WA (US)

( * ) Notice: Subject to any disclaimer, the term of this patent is extended or adjusted under 35 U.S.C. 154(b) by 84 days.

(21) Appl. No.: 16/819,410

(22) Filed: Mar. 16, 2020

(65) Prior Publication Data

US 2020/0339916 A1 Oct. 29, 2020

Related U.S. Application Data

(63) Continuation of application No. PCT/US2018/055196, filed on Oct. 10, 2018.

(60) Provisional application No. 62/570,131, filed on Oct. 10, 2017.

(51) Int. Cl.

| | |
|---|---|
| ***C11D 7/16*** | (2006.01) |
| ***C11D 3/38*** | (2006.01) |
| ***C11D 11/00*** | (2006.01) |
| ***C11D 3/12*** | (2006.01) |
| ***C11D 3/06*** | (2006.01) |
| ***C11D 3/10*** | (2006.01) |
| ***C11D 3/382*** | (2006.01) |
| ***A62D 3/02*** | (2007.01) |
| ***E01H 3/00*** | (2006.01) |
| ***C11D 3/04*** | (2006.01) |
| *A62D 101/20* | (2007.01) |

(52) U.S. Cl.

CPC ..... *C11D 3/381* (2013.01); *A62D 3/02* (2013.01); *C11D 3/046* (2013.01); *C11D 3/06* (2013.01); *C11D 3/10* (2013.01); *C11D 3/126* (2013.01); *C11D 3/1213* (2013.01); *C11D 3/382* (2013.01); *C11D 11/0052* (2013.01); *E01H 3/00* (2013.01); *A62D 2101/20* (2013.01)

(58) Field of Classification Search

CPC ..... C11D 3/06; C11D 3/1253; C11D 3/362; C11D 3/381; C11D 3/395; C11D 11/0005; C11D 11/0011

See application file for complete search history.

(56) References Cited

U.S. PATENT DOCUMENTS

| | | | | |
|---|---|---|---|---|
| 4,349,633 A * | 9/1982 | Worne | ..... | C12N 1/26 435/281 |
| 6,267,888 B1 * | 7/2001 | Satyanarayana | ..... | C02F 3/344 210/610 |
| 2016/0017373 A1 * | 1/2016 | Ganti | ..... | C02F 3/344 435/170 |
| 2018/0016545 A1 * | 1/2018 | Kjolhamar | ..... | C12N 1/26 |

* cited by examiner

*Primary Examiner* — Charles I Boyer
(74) *Attorney, Agent, or Firm* — John R Benefiel

(57) ABSTRACT

A composition for removing spillage on asphalt paving of hydrocarbon substances which includes modifiers, chemical oxidizers and bacteria which metabolizes both the spillage and a softened top layer of asphalt paving to aid in rehardening the surface of the mat while not metabolizing the underlying asphalt paving unaffected by the spillage.

2 Claims, No Drawings

ASPHALT SURFACE CLEANING COMPOSITION WITH BITUMEN REHARDENING AND METHOD

CROSS REFERENCE TO RELATED APPLICATION

This application claims the benefit of International application no. PCT/US2018/055196, filed on Oct. 10, 2018 which claims the benefit of provisional application No. 62/570,131 International filed on Oct. 10, 2017.

FIELD OF THE INVENTION

This invention concerns removal of hydrocarbons asphalt paving and treatment of the effects of such spills on the asphalt pavement.

BACKGROUND OF THE INVENTION

Asphalt roadways commonly use bitumen to bind aggregates together in pavement systems. Bitumen begins to oxidize and harden when exposed to atmospheric oxygen, which occurs during mixing with aggregate, storage, transport to the roadway area, and laying of the asphalt. Those skilled in the art have also employed chemical oxidizers and other additives in the hot mix asphalt batch process to achieve the desired hardness of bitumen for a particular use or geographic area. After laying, bitumen will continue to harden on the roadway, particularly on the roadway surface.

Microbes have also been identified by those skilled in the art, for their ability to increase the viscosity (hardness) of bitumen particularly, but is not believed to be known to have been used in an asphalt cleaning composition for that purpose.

The hardened layer near the surface of asphalt paving is known to protect the roadway from damage. When the upper layers of asphalt pavement is exposed to spills of hydrocarbons, the layer of protection is compromised as the hydrocarbons penetrate into deeper layers of the roadway. Softening of the interior asphalt layers leads to deformation of the roadway by vehicles, a loss of binding ability of the bitumen, and eventually a loss of the aggregates and the creation of potholes.

SUMMARY OF THE INVENTION

The present invention comprises a composition and method for removing spills of hydrocarbons on asphalt as having the ability to reharden and re-oxidize the surface layers of the asphalt, through a combination of bacteria metabolism and chemical oxidizers. As the bacteria metabolize the lighter fractions of hydrocarbons, e.g. fuels and oils, they also have been found by the present inventors to metabolize the softened surface bitumen, oxidizing it and increasing its viscosity. After the softened surface bitumen is metabolized, the bacteria cease further activity and die off to be self-limiting in their activity.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

An effective bacteria for use in practicing the invention is a blend of *Pseudomonas* and *Bacillus* bacterial strains. The specific bacteria used to consume chain hydrocarbons and oxidize long chain hydrocarbons are *Pseudomonas putida, Pseudomonas fluorescens, Bacillus licheniformis, Bacillus megaterium, Bacillus pumilus, Bacillus subtilis.*

These bacteria can be obtained from Envera, a company in West Chester, Pa. that specializes in the isolation, large scale production, stabilization and product formulation of microgranisms. The company has isolated bacteria known to utilize hydrocarbons as a food source.

Research has shown that these bacteria can have an influence on asphalt viscosity and have been known to either soften or harden asphalt, depending on the bacteria present. The bacteria chosen for the present invention were selected based on their ability to harden asphalt surfaces, increasing viscosity via oxidation. The hardening action is due to the conversion of lower weight hydrocarbons to high modecular weight oxygenated compounds, as well as the polymerization of unsaturated compounds.

The microbes described are assisted in breaking down the short-chain hydrocarbons by the chemical oxidizers and surfactants also forming a part of the composition according to the invention.

That is, hardening is accelerated by other components used in the composition of the invention. Oxidation occurs naturally in binders when asphalt pavement ages and is exposed to atmospheric oxygen. Groups of molecules that are polar and contain oxygen are formed and begin to associate into other molecular groups, increasing the viscosity of the bitumen. Oxidizers in the present invention assist with the re-introduction of oxygen to the upper layers of damaged asphalt pavements.

Surfactants emulsify the smaller chain hydrocarbons, allowing faster metabolism by microbial action. Furthermore, the chemical oxidizers employed in the cleaning composition, which in traditional use, have only been applied during the hot mix phases to achieve desired hardness for a particular grade of asphalt, re-oxidize softened bitumen through chemical reaction and re-polymerization, particularly when used in conjunction with bacteria and with the assistance of absorbent cleaning materials also used in the composition of the invention. Absorbents are also used which pull away lighter fractions of hydrocarbons and other volatiles and sequester them in the surface. After application of the cleansing composition of this invention on damaged surface layers of asphalt pavement roadways, the hardening action was found to occur in hydrocarbon-damaged asphalt but not in undamaged asphalt.

A preferred formula for cleaning composition is shown in the accompanying chart (% by weight).

The ingredients are in the form of powders blended together in a mixer, which can be applied to a contaminated area. Alternatively, a water based form of the composition can be sprayed on the surface.

1. Modifiers—(ingredients—Attapulgite, Styrene Butadiene Styrene, Bentonite, Calcium Carbonate, Fly Ash).

Modifiers chemically change the composition and condition of bitumen damaged from contaminants (such as: oil, diesel, gasoline, or other hydrocarbon-based fluids). Contaminants can act as a solvent that softens the binder of asphalt to cause premature damage and degradation of the asphalt surface. The composition of the invention may include with modifiers and/or other polymers modifiers to harden the bitumen surface. Through contact with the modifying agents, this solution utilizes a chemical reaction to harden the damaged bitumen toward a condition more consistent with its original condition, potentially producing an even harder surface structure, in order to prevent further damage and degradation caused by the contaminants.

2. Chemical Oxidizers—(ingredients—Sodium Percarbonate, Sodium Perborate, Sodium Tripolyphosphate, Trisodium Phosphate)

The chemical oxidizers increase the viscosity of bitumen as polar hydroxyl, carbonyl, and carboxylic groups are formed, which result in larger and more complex molecules that make bitumen harder and less flexible. The softening points of oxidized grades of bitumen are much higher than those of other grades.

3. Microbes—(Ingredient: Bacteria)

Microorganisms or bacteria aid in the removal of contaminants through bioremediation. Bacteria in the composition oxidize hydrocarbons on the asphalt surface through metabolic processes as they utilize hydrocarbons as a food source, resulting in an increase in viscosity (hardness) of the surfaces damaged by the hydrocarbon contamination.

Chart follows on separate page:

| | % Breakdown | Purpose |
|---|---|---|
| Pumice | 20-25% | Oil adsorbent, asphalt stabilizer, traction, asphalt binding |
| Bentonite | 30-40% | Clay, used in bitumen modification to harden asphalt mixes, decrease penetration |
| Ground Trisodium Phosphate | 1-5% | Surfactant, enables Bentonite emulsification, assists with bacterial consumption |
| Calcium Carbonate | 20-25% | Used in asphalt paving, a filler, soil stabilizer, used to make mortar, interacts with clay |
| Proprietary Bacteria | 1-5% | Bioremediates excess oils, oxidizes top layer of asphalt |
| Sodium Perborate | 1-5% | Surfactant, oxidizer. Used to pre-oxidize bitumen/increase hardness in hot mix |
| Humic Acid | 1-5% | Nutrition source for bacteria |
| Syntetic Iron Oxide | 1-5% | Color |
| Sodium tripolyphosphate | 1-5% | Surfactant, enables Bentonite emulsification, assists with bacterial consumption |

The invention claimed is:

1. A composition for removal of spillage of hydrocarbon substances on asphalt paving and treating the softening effect on the surface of the asphalt paving comprising a mixture of the following materials of a percentage by weight:

Pumice—20-25%
Bentonite—30-40%
Ground Trisodium phosphate—1-5%
Calcium carbonate—20-25%
Bacteria which metabolizes softened asphalt but not unsoftened asphalt—1-5%
Sodium Perborate—1-5%
Humic Acid—1-5%
synthetic Iron Oxide—1-5%
Sodium tripolyphosphate—1-5%.

2. A method of cleaning up a hydrocarbon spillage on asphalt paving comprising applying the composition of claim 1 to the surface of the asphalt paving which has been softened by said hydrocarbon spillage such that the hydrocarbon spillage and softened asphalt are metabolized, but the unsoftened asphalt below said softened top surface is not metabolized.

* * * * *